US006209231B1

(12) United States Patent
Curtis

(10) Patent No.: US 6,209,231 B1
(45) **Date of Patent: *Apr. 3, 2001**

(54) VEHICLE HITCH MOUNT ASSEMBLY FOR A SNOW PLOW

(75) Inventor: Marc D. Curtis, Spencer, MA (US)

(73) Assignee: Curtis International, Inc., Worcester, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,448

(22) Filed: Dec. 29, 1998

Related U.S. Application Data

(63) Continuation-in-part of application No. 09/134,555, filed on Aug. 14, 1998, now Pat. No. 6,145,222.

(51) Int. Cl.[7] ..... E01H 5/04

(52) U.S. Cl. ..... 37/231; 37/235

(58) Field of Search ..... 37/231, 232, 234, 37/235, 236, 266, 268

(56) References Cited

U.S. PATENT DOCUMENTS

| | | | |
|---|---|---|---|
| 1,890,730 | 12/1932 | Hunt . | |
| 1,918,771 | 7/1933 | Meyer . | |
| 2,057,326 | 10/1936 | Coates | 37/42 |
| 2,119,263 | 5/1938 | Baumgardner | 280/33.1 |
| 2,141,558 | 12/1938 | Richter | 37/42 |
| 2,426,410 | 8/1947 | Owen | 37/42 |
| 2,577,145 | 12/1951 | Nearing et al. | 280/33.15 |
| 2,642,294 | 6/1953 | Holm | 280/33.13 |
| 2,662,459 | 12/1953 | Shore | 97/47.15 |
| 2,667,708 | 2/1954 | Gjesdahl | 37/42 |
| 2,697,289 | 12/1954 | Standfuss | 37/42 |
| 2,703,244 | 3/1955 | Nearing | 280/504 |
| 2,710,464 | 6/1955 | Husting | 37/42 |
| 3,098,309 | 7/1963 | Koch | 37/42 |
| 3,150,884 | 9/1964 | Drott | 280/460 |
| 3,214,138 | 10/1965 | Jocher et al. | 254/124 |
| 3,250,026 | 5/1966 | Jocher et al. | 37/42 |
| 3,285,625 | 11/1966 | Krueger | 280/479 |
| 3,343,850 | 9/1967 | Stauss et al. | 280/504 |
| 3,388,929 | 6/1968 | Miley | 280/481 |
| 3,410,008 | 11/1968 | Standfuss | 37/42 |

(List continued on next page.)

FOREIGN PATENT DOCUMENTS

| | | |
|---|---|---|
| 916646 | 12/1972 | (CA) . |
| 1182638 | 2/1985 | (CA) . |
| 1220022 | 4/1987 | (CA) . |
| 1253003 | 4/1989 | (CA) . |
| 2023065 | 10/1991 | (CA) . |
| 2027411 | 4/1992 | (CA) . |
| 1300877 | 5/1992 | (CA) . |
| 1303352 | 6/1992 | (CA) . |
| 1318786 | 6/1993 | (CA) . |
| 2121948 | 10/1994 | (CA) . |
| 2090992 | 5/1996 | (CA) . |
| 2137853 | 1/1999 | (CA) . |
| 1164323 | 2/1964 | (DE) . |
| 1255376 | 11/1967 | (DE) . |
| 1272636 | 8/1961 | (FR) . |
| 1489716 | 7/1967 | (FR) . |

*Primary Examiner*—Thomas B. Will
*Assistant Examiner*—Gary S. Hartmann
(74) *Attorney, Agent, or Firm*—Nields & Lemack

(57) ABSTRACT

Hitch mount for hydraulically driven snow blades or other accessories that includes a receiver plate for mounting to the vehicle chassis and a one piece plow assembly and lift frame readily removably coupled to the receiver plate, the plow assembly preferably including a blade trip frame and a snow blade removably coupled to the trip frame. A optional power operated jack can be used to raise or lower the lift frame relative to the vehicle chassis.

13 Claims, 11 Drawing Sheets

U.S. PATENT DOCUMENTS

| | | | | |
|---|---|---|---|---|
| 3,412,489 | | 11/1968 | Klapprodt et al. | 37/42 |
| 3,427,046 | | 2/1969 | Sommet et al. | 280/479 |
| 3,434,737 | | 3/1969 | Bailey et al. | 280/461 |
| 3,483,641 | | 12/1969 | Hirt | 37/44 |
| 3,512,804 | | 5/1970 | Siegert | 280/509 |
| 3,528,685 | | 9/1970 | Eatsman | 280/479 |
| 3,531,140 | | 9/1970 | Di Vita et al. | 280/477 |
| 3,746,368 | | 7/1973 | Gledhill et al. | 280/481 |
| 3,760,883 | | 9/1973 | Birk | 172/273 |
| 3,793,752 | | 2/1974 | Snyder | 37/42 R |
| 3,815,687 | | 6/1974 | Federspiel | 172/801 |
| 3,851,894 | | 12/1974 | St. Pierre | 280/460 R |
| 3,876,092 | | 4/1975 | MacDonald | 214/145 |
| 3,987,562 | * | 10/1976 | Deen et al. | 37/42 R |
| 4,074,448 | | 2/1978 | Niemela | 37/41 |
| 4,090,725 | | 5/1978 | Perin | 280/479 A |
| 4,127,951 | | 12/1978 | Hutch | 37/44 |
| 4,176,727 | | 12/1979 | Perin | 180/53 R |
| 4,187,624 | | 2/1980 | Blau | 37/42 R |
| 4,205,825 | | 6/1980 | Stanford | 254/86 R |
| 4,236,329 | | 12/1980 | Hetrick | 37/42 R |
| 4,253,793 | | 3/1981 | Braml | 414/723 |
| 4,255,884 | | 3/1981 | Williams | 37/117.5 |
| 4,259,794 | | 4/1981 | Rath | 37/42 |
| 4,265,587 | | 5/1981 | Clark | 414/723 |
| 4,268,058 | | 5/1981 | Farrell et al. | 280/481 |
| 4,342,163 | | 8/1982 | Hoekstra | 37/231 |
| 4,391,052 | | 7/1983 | Guy, Jr. | 37/236 |
| 4,436,477 | | 3/1984 | Lepertz et al. | 414/723 |
| 4,439,939 | | 4/1984 | Blau | 37/231 |
| 4,452,560 | | 6/1984 | Coyle et al. | 414/723 |
| 4,462,172 | | 7/1984 | Caron | 37/231 |
| 4,574,502 | | 3/1986 | Blau | 37/266 |
| 4,619,060 | * | 10/1986 | Knowlton | 37/231 |
| 4,658,519 | | 4/1987 | Quenzi | 37/23 |
| 4,717,166 | | 1/1988 | Vachon | 280/481 |
| 4,744,159 | | 5/1988 | Houle | 37/231 |
| 4,747,612 | | 5/1988 | Kuhn | 280/460 A |
| 4,807,375 | | 2/1989 | Iraci | 37/236 |
| 4,817,728 | | 4/1989 | Schmid et al. | 172/273 |
| 4,821,435 | | 4/1989 | Pester | 37/231 |
| 4,833,799 | | 5/1989 | Harte et al. | 37/231 |
| 4,962,599 | | 10/1990 | Harris | 37/266 |
| 4,976,053 | | 12/1990 | Caley | 37/231 |
| 4,999,935 | | 3/1991 | Simi et al. | 37/236 |
| 5,014,452 | | 5/1991 | Berghefer | 37/235 |
| 5,027,536 | | 7/1991 | Farrell | 37/236 |
| 5,031,927 | | 7/1991 | Frenette | 280/481 |
| 5,050,322 | | 9/1991 | Burkard | 37/270 |
| 5,082,065 | | 1/1992 | Fletcher | 172/273 |
| 5,088,215 | | 2/1992 | Ciula | 37/197 |
| 5,111,603 | * | 5/1992 | Knowlton et al. | 37/231 |
| 5,125,174 | | 6/1992 | Watson et al. | 37/231 |
| 5,136,795 | | 8/1992 | Rosenberg | 37/233 |
| 5,145,313 | | 9/1992 | Weyer | 414/723 |
| 5,155,929 | | 10/1992 | Vachon | 37/266 |
| 5,195,261 | | 3/1993 | Vachon | 37/231 |
| 5,244,047 | | 9/1993 | Eudy | 172/275 |
| 5,353,530 | | 10/1994 | Pieper | 37/231 |
| 5,361,519 | | 11/1994 | Ciula et al. | 37/234 |
| 5,368,409 | | 11/1994 | Marzullo et al. | 403/324 |
| 5,397,187 | | 3/1995 | Cachinero et al. | 384/460 |
| 5,415,235 | | 5/1995 | Gebauer | 172/273 |
| 5,456,030 | | 10/1995 | Barone et al. | 37/468 |
| 5,485,690 | * | 1/1996 | MacQueen | 37/271 |
| 5,524,368 | | 6/1996 | Struck et al. | 37/235 |
| 5,568,694 | | 10/1996 | Capra et al. | 37/231 |
| 5,743,339 | | 4/1998 | Alexander, III | 172/272 |
| 5,778,567 | * | 7/1998 | Jager et al. | 37/235 |
| 5,806,214 | * | 9/1998 | Behrens et al. | 37/231 |
| 5,815,956 | * | 10/1998 | Lavin et al. | 37/241 |
| 5,915,837 | | 6/1999 | Brown et al. | 37/468 |

* cited by examiner

VEHICLE HITCH MOUNT ASSEMBLY FOR A SNOW PLOW

This application is a continuation-in-part of Ser. No. 09/134,555 filed Aug. 14, 1998 now Pat No. 6,145222.

BACKGROUND OF THE INVENTION

Conventional snow blade mounts for four wheel drive vehicles such as pick-up trucks can weigh several hundred pounds, and generally include a chassis frame that can be permanently fixed to the vehicle chassis, usually behind the vehicle front bumper. A lift frame is then removably coupled to the chassis frame, and the snow blade is then coupled to the front end of the assembly via an A-frame and trip frame assembly. The A-frame with the snow blade attached is typically removable from the vehicle. Conventionally, the lift frame has been permanently mounted to the chassis frame (and therefore not readily removable from the vehicle), and the hydraulic pump used to operate the snow blade was located under the vehicle hood, and were driven using a belt drive driven by the vehicle engine. However, safety considerations now often dictate that the lift frame be removed when the plow is not in use. In addition, crash zones and barrier testing are altered by locating the electric/hydraulic pump under the vehicle hood in juxtaposition with the vehicle engine. Moreover, such a location is also no longer feasible since there is little room there to accommodate the pump, and since most vehicles today use a single serpentine belt, again eliminating the feasibility of driving the hydraulics with a belt driven by the vehicle engine. Accordingly, most snow blade mounts today locate the blade actuator drive assembly in front of the vehicle grill, slightly higher than the vehicle front bumper. This arrangement hinders air flow to the vehicle engine, often resulting in engine overheats.

One drawback of conventional snow blade mounts is the difficulty in readily removing the lift frame assemblies from the vehicle chassis, especially in view of their weight. To that end, U.S. Pat. No. 5,125,174 discloses a removable snowplow including a removable lift frame and A-frame combination. However, the lift frame assembly is permanently mounted to the A-frame, thus requiring removal of both simultaneously, as a unit. U.S. Pat. No. 5,353,530 is of a similar vein.

Conventional mounting systems utilize a pin arrangement, whereby the vehicle and mount assembly must be properly aligned prior to coupling the mount to the chassis with a pair of pins. This mounting and dismounting is difficult and tedious.

It is therefore an object of the present invention to provide a snow blade mount and lift assembly for a vehicle that is easily attachable and removable from the vehicle.

It is a further object of the present invention to provide a hydraulically operated snow blade and lift assembly for a vehicle that is attached and removed from the vehicle using a self-aligning hitch mount devoid of conventional mounting pins.

It is yet a further object of the present invention to provide a snow blade hitch mount that includes a jack for lifting the assembly for proper vertical alignment with the vehicle chassis mount receiving plate.

SUMMARY OF THE INVENTION

The problems of the prior art have been overcome by the present invention, which provides a mount and lift assembly for hydraulically driven snow blades or other accessories that includes a receiver plate for mounting to the vehicle chassis and a one piece plow assembly and lift frame readily removably coupled to the receiver plate, the plow assembly preferably including a blade trip frame and a snow blade removably coupled to the trip frame.

DETAILED DESCRIPTION OF THE INVENTION

Figure 1:
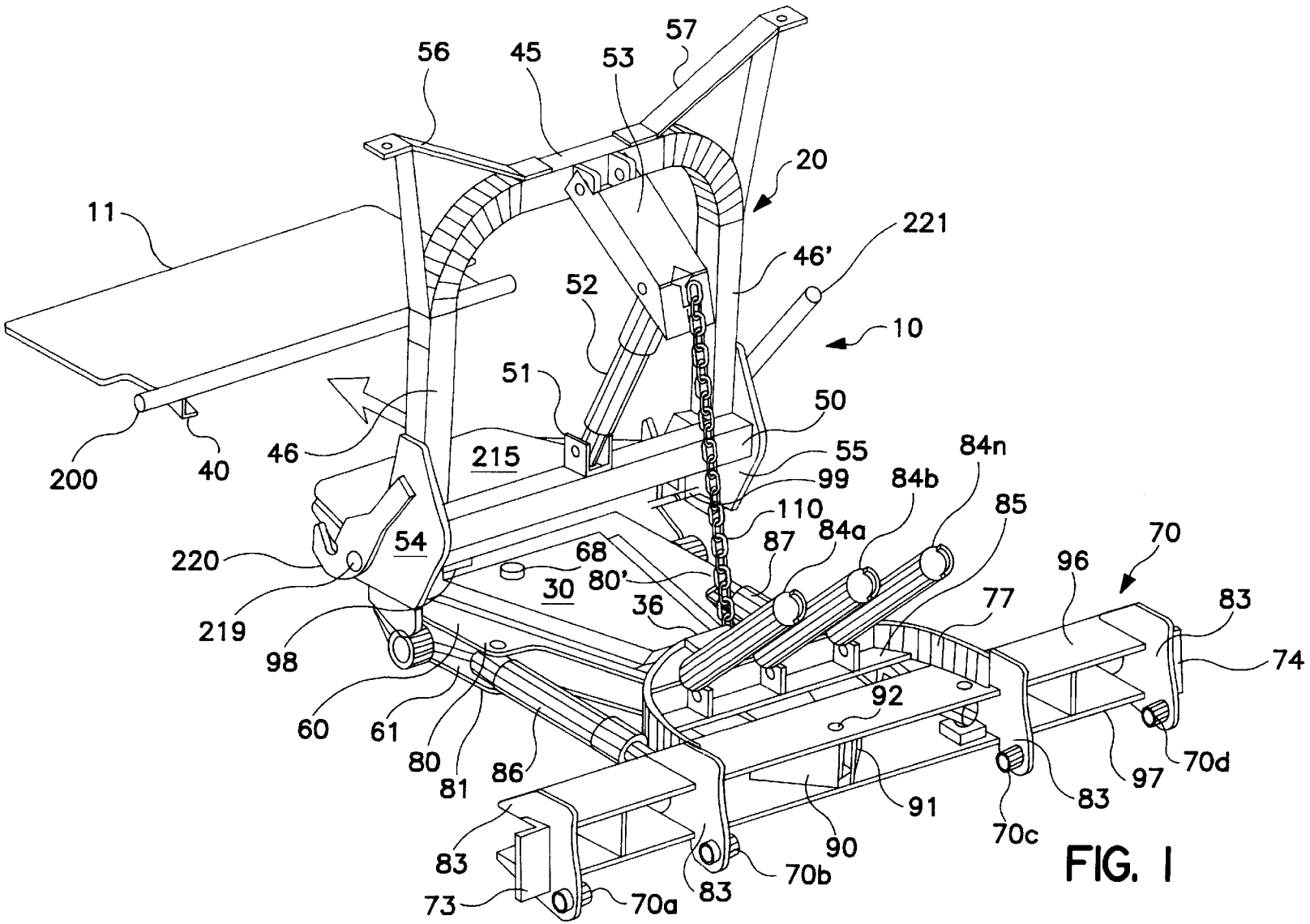
FIG. 1 is a perspective exploded view of the snow blade mounting system in accordance with the present invention.

Turning first to FIG. 1, there is shown generally at 10 the snow blade lift and hitch assembly in accordance with a preferred embodiment of the present invention. Vehicle mounted receiver plate 11 attaches to the vehicle the chassis frame (not shown) behind the front bumper by means of pins or bolts (not shown). Any suitable means can be used to secure the receiver plate 11 to the chassis, such as bolting. The actual design of the receiver plate 11 interface for attachment to the chassis will depend upon the identity (and thus design) of the particular chassis, and is well within the skill in the art.

The receiver plate 11 preferably remains permanently mounted to the vehicle chassis, regardless of whether the snow blade or other accessories are in use. It is fixed and has no moving parts; its main purpose being to provide a means of attachment of the follow-on components, such as those that provide the lift and angle of the snow blade where the follow-on component is a snow blade, and to absorb and transfer any shock loads imposed on the snow blade (or other accessory) into the vehicle chassis.

Figure 3:
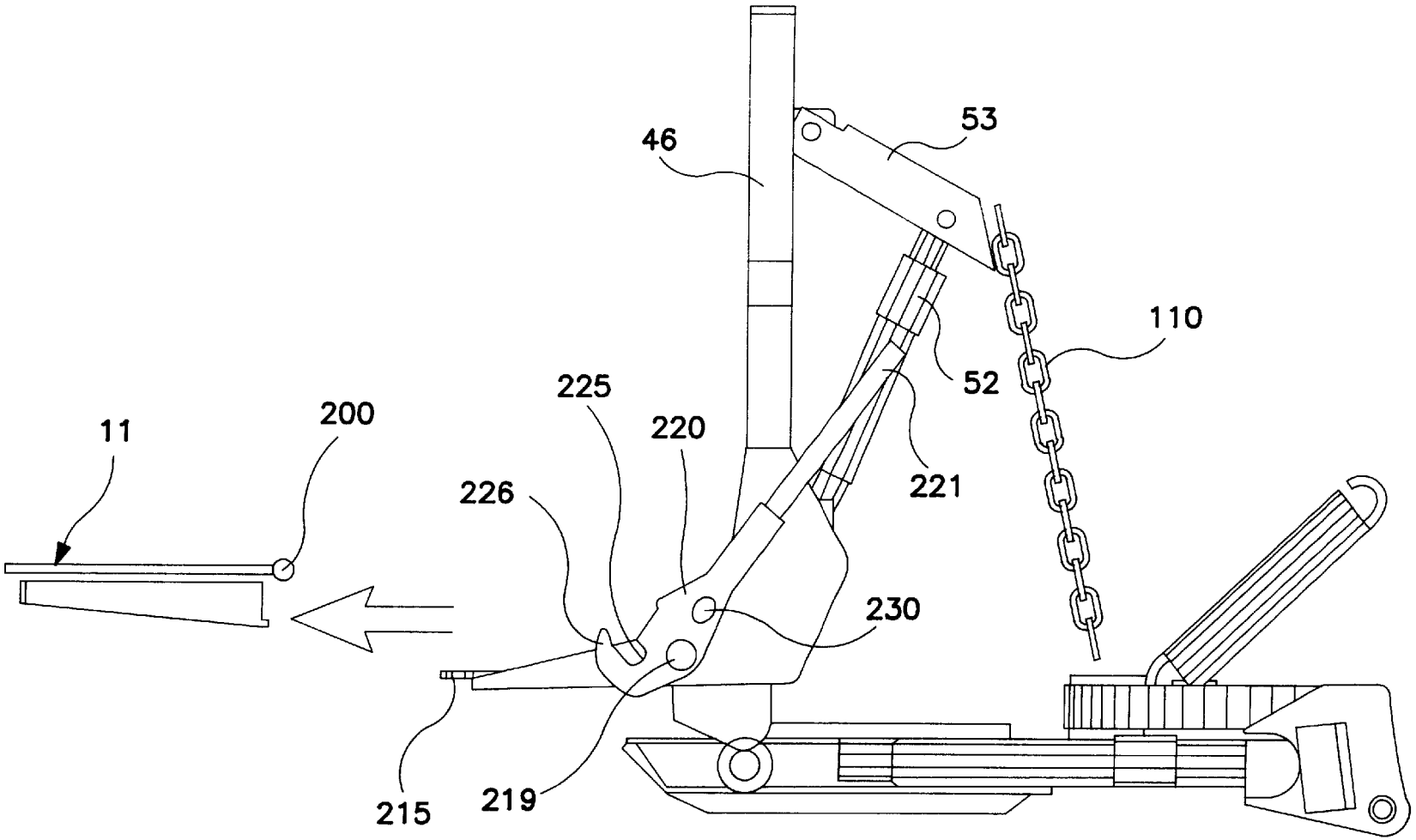
FIG. 3 is side exploded view of the snow blade mounting system in accordance with the present invention.

With particular reference to FIG. 3, a receiver arrangement is created for the removable lift frame 20 and A-frame 30 integral therewith, or for any other accessory to be attached to the vehicle via the receiver plate 11. A pair of spaced side guides 40, 41 extend vertically downward from the top plate FIG. 1) or frame (FIG. 8) of receiver plate 11, and then inward toward each other as shown. The guides are preferably in a tapered profile such that the distance between them decreases in the direction towards the vehicle rear. The height of each side guide 40. 41 is also tapered such that it is progressively lower in the direction towards the vehicle rear. These angled side guides thus angle in and up, creating a trapezoidal wedge in both planes to provide a positive grip to the matching plow mounted hitch. The snow plow and lift frame assembly engaging end of the receiver plate 11 is preferably formed with a lip 21 to facilitate entry and guiding of the assembly between the side guides 40, 41.

Tubular lift frame 20 and A-frame 30 assembly is adapted to be releasably coupled to the receiver plate 11. The following description of the lift frame 20 and A-frame 30 is similar to that disclosed in co-pending U.S. Ser. No. 08/640,145, the disclosure of which is incorporated herein by reference, although those skilled in the art will appreciate that the present invention is not limited to that particular lift frame and A-frame design. The lift frame 20 as shown has a generally rectangular shape, although the present invention is not to be so limited. A transverse vertical actuator support tube 50 is coupled to the frame 20 between side gusset plates 54, 55, and includes a central bracket 51 for attachment of one end of a vertical lifting means 52 such as a hydraulically driven actuator or cylinder. The opposite end of the vertical lifting means 52 is coupled to pivot hood 53, which in turn is pivotally mounted to the underside of top cross bar 45 of the frame 20 as shown. The pivot hood 53 has means to which one operative end of a linking means such as a chain 110 or the like can be mounted. The other operative end of the linking means is mounted by any suitable means to an angle iron coupled to the snow plow blade, so that actuation of the vertical lifting means 52 causes a corresponding vertical lift of the hood 53, which thereby lifts the snow plow blade.

Side gussets 54, 55 are shown coupled to vertical legs 46, 46' of the lift frame 20, such as by welding, and will be discussed in greater detail below. Triangular light mounts 56, 57 are provided on the frame 20 to support additional lighting or the like. Fixed to inside edges of the legs 46, 46' of the lift frame 20 are opposite right angle A-frame limit stops 98, 99 positioned to prevent the A-frame 30 from lifting too high.

A compartment in the A-frame 30 is defined by a top plate 60 and an opposite, substantially co-extensive and spaced parallel bottom plate 61. A ring block 36 comprising a tubular base section and a top plate and is mounted on the top surface of the A-frame and mates to a stabilizer ½ ring 77 attached to the trip frame 70. The block 36 contains and stabilizes the ½ ring 77, thus stabilizing the trip frame to which the ½ ring 77 is attached. Those skilled in the art will appreciate that the ring block 36 can be designed having shapes other shapes than that shown, as long as the ring properly stabilizes the trip frame assembly 70.

Located in the body of the A-frame substantially between top and bottom surfaces 60, 61 is an actuator drive cavity. Locating the actuator drive means (preferably an electric/hydraulic pump assembly) substantially within the body of the A-frame 30 lightens the lift frame 20 (where the pump was conventionally located) for easy removal. Instead, the dead weight of the actuator drive means is advantageously added to the blade, assisting in creating a cleaner snowplow pass. Importantly, the actuator drive means in this location in no way obstructs the radiator of the vehicle, thereby allowing proper air flow to cool the vehicle engine and help prevent overheating. In addition, the actuator drive means is well sheltered, minimizing potential damage as the vehicle approaches the blade assembly for mounting. It also allows for shorter hydraulic lines to the angle pistons, and allows for more clearance in the basic geometry, thereby allowing higher blade motion for stacking snow. Preferably, the bulk of the actuator drive means is located substantially in the horizontal plane of the A-frame defined by the top and bottom surfaces 60, 61. Most preferably, a lower recess/skid plate coupled to the underside of plate 61 supports the pump assembly slightly below the plane of plate 61 of the A-frame 30, thereby maximizing the lift height of the A-frame 30. A removable top cover optionally having a hydraulic fluid reservoir fill cap 68 provides further protection for the pump assembly.

Trip frame assembly 70 is the preferred means for attaching the snow blade to the A-frame 30. The trip frame 70 allows the blade to pivot forward, which allows it to trip over obstacles and absorb shock that would otherwise be transferred into the plow frame assembly and vehicle, which in extreme cases would cause substantial damage. The front of the trip frame 70 is defined by a trip frame angle pivot, which comprises a top horizontal plate 96 and a spaced, parallel, co-extensive bottom horizontal plate 97. Angled plates 90, 91 receive the apex of the A-frame and provide a stop. The A-frame is pivotally mounted through axially aligned hole 92 in horizontal plates 96, 97. The trip frame angle pivot includes four horizontal axially aligned pivot bushings 70*a*–70*d* each mounted on a rib 83 intersecting horizontal top and bottom plates 96, 97. The pivot bushings 70*a*–70*d* each mate to a recess 71 formed in the back of the plow blade. Welded at extreme opposite ends of trip frame 70 are right angle blade trip stops 73, 74. These provide an angled stop against the vertical blade rib of blade. Were the blade allowed to trip forward all the way to the ground, it could become lodged or could spring board up very abruptly, causing damage. In addition, the lower stop keeps the spring extension within its designed operating range which prevents the springs from stretching (overstretching of the springs permanently damages the springs, making them unable to return the blade to its full upright position).

Those skilled in the art will recognize that the foregoing trip frame assembly is not required; the snow blade can articulate directly from the A-frame and by directly coupled thereto via pistons and pivots. Other trip frame designs could also be used.

Welded on the top cross bar 96 is the ½ ring 77 mentioned above, which stabilizes the trip assembly and pivot. A right angle cross bar 85 is positioned within the ½ ring 77, and supports a plurality of trip return springs means 84*a*–84*n* (three shown). The opposite ends of the return springs means 84 are coupled to the snow blade through an upper spring mount on the rear of the blade.

A pair of spaced horizontal actuators such as cylinders 86, 87 are each mounted at one end between top and bottom horizontal plates 96, 97. The opposite ends of each horizontal actuator 86, 87 are pivotally coupled to the A-frame at shoulders 80, 80', 81, 81'. These horizontal actuators 86, 87 are operatively connected to the actuator drive assembly (not shown) housed in the A-frame 30 cavity by suitable hosing.

The snow blade can be conventional in design. The preferred blade is a sheet of steel bumped or rolled to a semi-round shape and then braced on the backside with a plurality of vertical ribs and horizontal members comprised of formed stiffeners and a frog angle at the very base to absorb shock. C-shaped shoe mounts coupled to the back of the plow blade provide a surface for the blade to ride on.

The controls for operating the assembly are housed inside the cab of the vehicle for easy access to the operator. Typically, there are two separate momentary contact switches in any position but the down position, where it is not momentary. A plurality of solenoids are used to control the mechanism, such as a solenoid to control the power that runs the motor for the pump. This circuit is energized off of any of the control positions except the down position, thereby actuating the pump to raise and/or angle the blade. Gravity allows the blade to return to ground. Three hydraulic solenoids are mounted to the output manifold of the pump. One is the unit that opens the path to lift the blade, another is the unit that opens the path to lower the blade assembly. In the up position, the first solenoid opens the valve and the pump is energized, which raises the blade. In the down position, the other solenoid opens its respective valve, but the pump is not energized, which allows the blade to lower.

There is a three-position hydraulic spool valve for the angling of the blade. As the switch is pushed to one side, it opens the corresponding valve and energizes the pump, which then pumps fluid into the corresponding piston which causes the piston to extend and to thereby angle the blade. At the same time, it allows the non-pressurized piston to collapse and fluid to return to the tank (the force of the extending piston collapses the opposite piston). When the switch is engaged in the other direction, the reverse occurs. When the switch is returned to the neutral position, so does the valve.

Figure 5A:
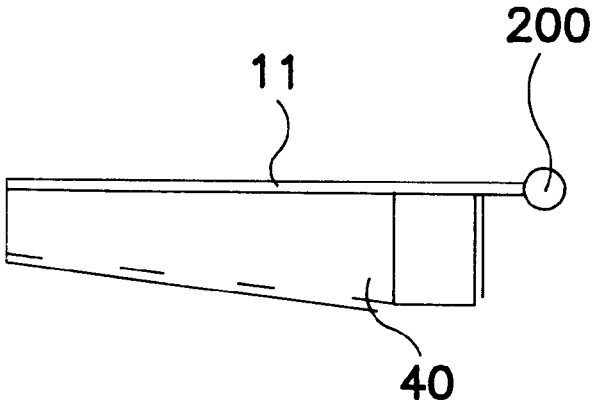
FIG. 5A is a side view of the vehicle mounted hitch receiver plate in accordance with the present invention.
Figure 5B:
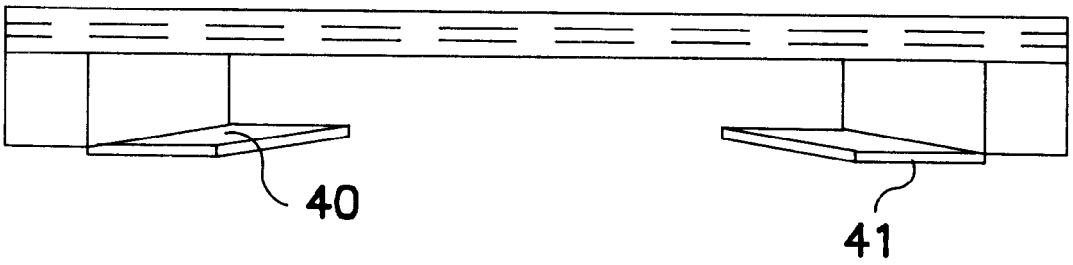
FIG. 5B is a front view of the vehicle mounted hitch receiver plate in accordance with the present invention.

Further details will now be provided regarding the hitch mount of the present invention. As discussed above, receiver plate 11, preferably made of ⅜" mild steel, is coupled to the vehicle chassis by suitable means. The front plow engaging end of the receiver plate 11 includes a round elongated bar or rod 200, preferably solid and 1" in diameter, secured to the receiver plate by suitable means such as welding. In the embodiment shown, the bar 200 extends horizontally a distance sufficient to be engaged at or near its opposite ends by a pair of opposite latch hooks 210 discussed in detail below. However, those skilled in the art will appreciate that the bar 200 need not be continuous; two separate bars could be used at each end of the receiver plate 11, as long as they are appropriately positioned for engagement by the latch hooks 210. Receiver plate 11 includes generally longitudinally extending (in the direction from the vehicle front to the vehicle rear) guide members 40, 41 as discussed above, which help ensure proper alignment of the lift assembly 20. The spacing or volume between these guide members and the top of receiver plate 11 (FIGS. 5A and 5B) is configured to accommodate the male end 215 of the hitch assembly coupled to the lift frame 20 via the side gussets 54, 55. Thus the male end 215 is preferably also trapezoidal in shape, with rounded corners to facilitate hitch engagement. Stated differently, the male end 215 is tapered such that the length of its free engaging end is shorter than the length of its opposite end coupled to the lift assembly. Similarly, guide members 40, 41 are configured and placed such that the receiver volume is tapered, with its end farthest from the vehicle front being shorter than the end at the bar 200. The guide members 40, 41 thus act as a track for receiving and aligning male end 215.

Figure 8:
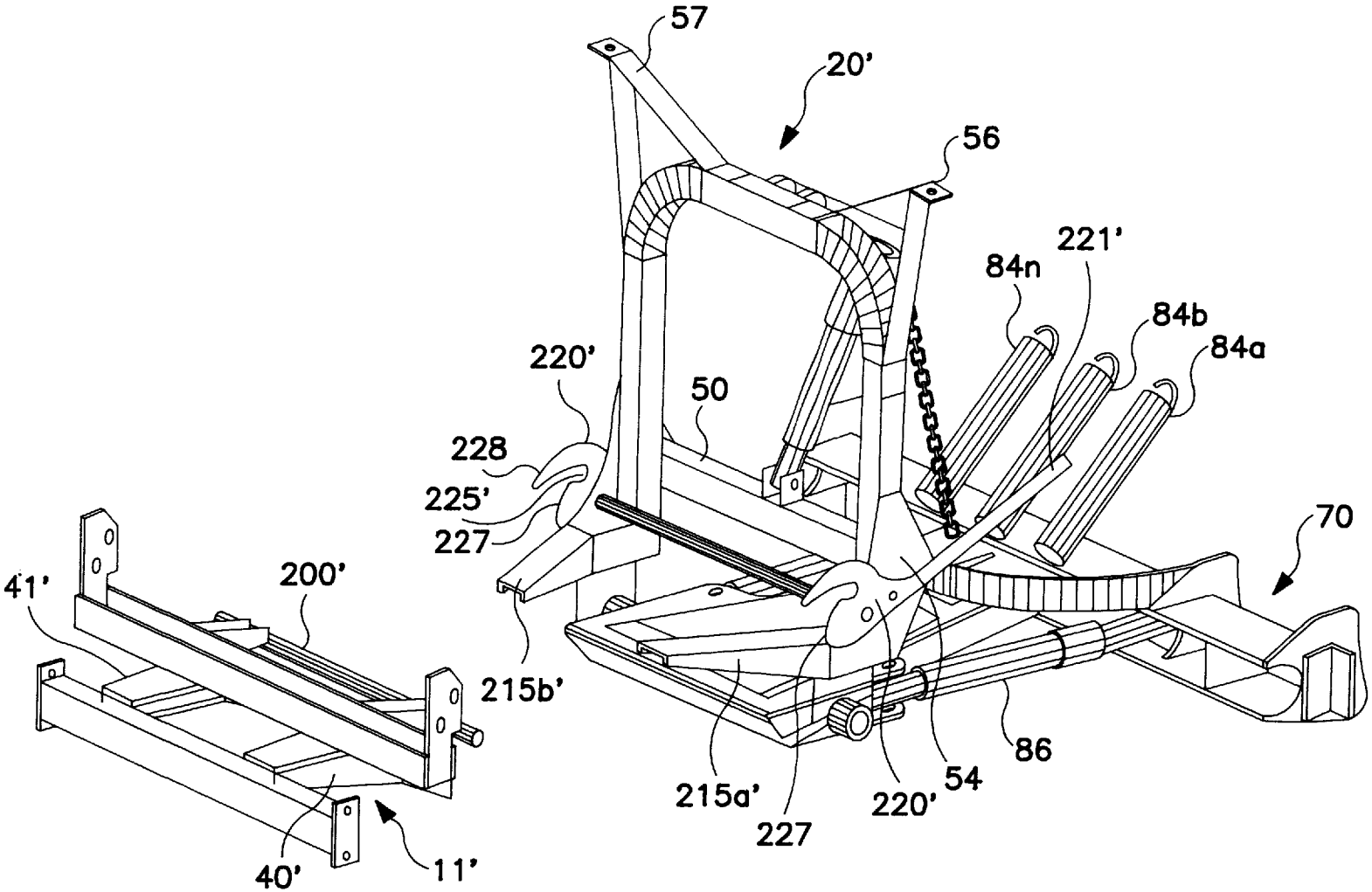
FIG. 8 is a perspective exploded rear ¾ view of the snow blade mounting system in accordance with an alternative embodiment of the present invention.
Figure 9:
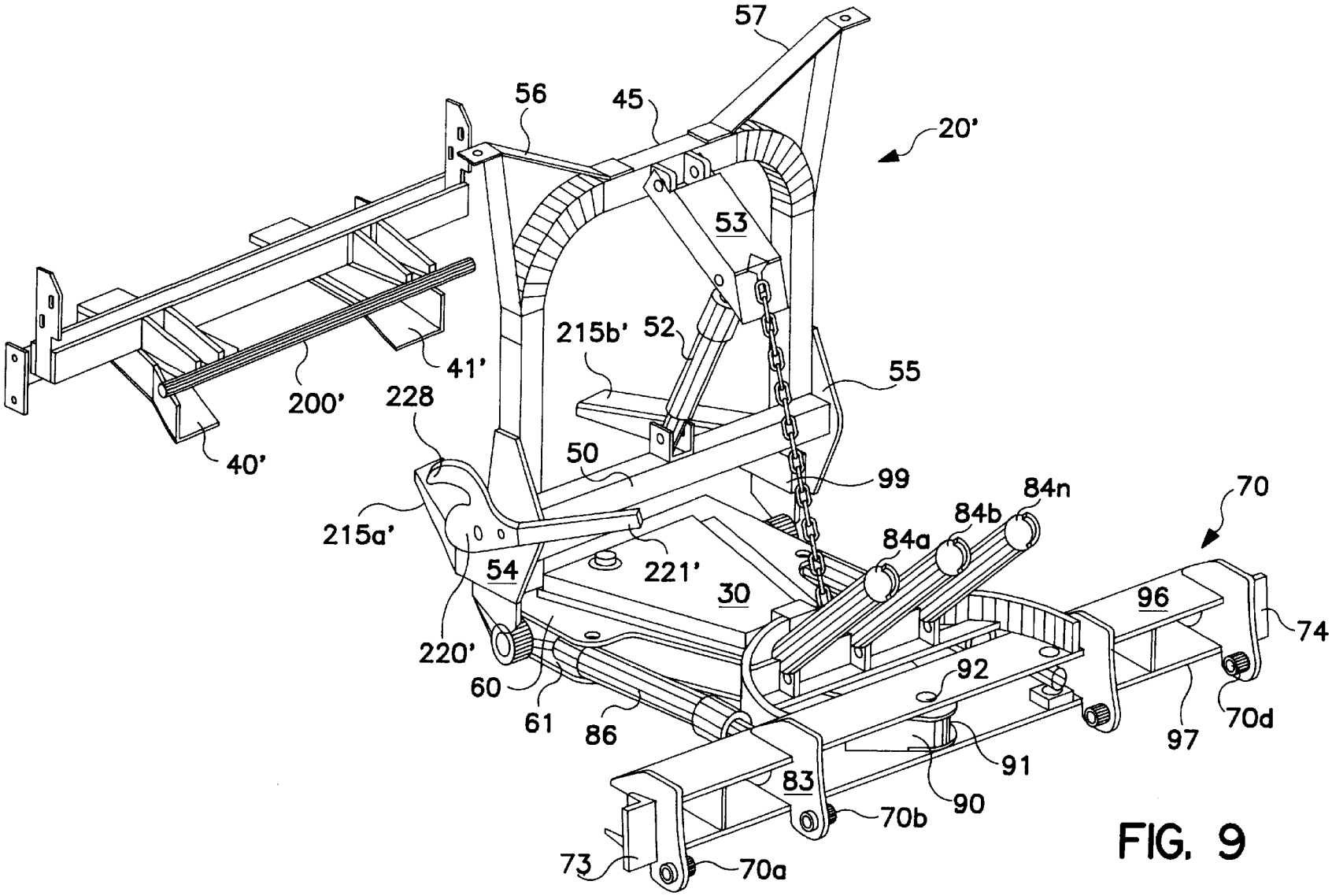
FIG. 9 is a perspective exploded front ¾ view of the snow blade mounting system in accordance with an alternative embodiment of the present invention.
Figure 10:
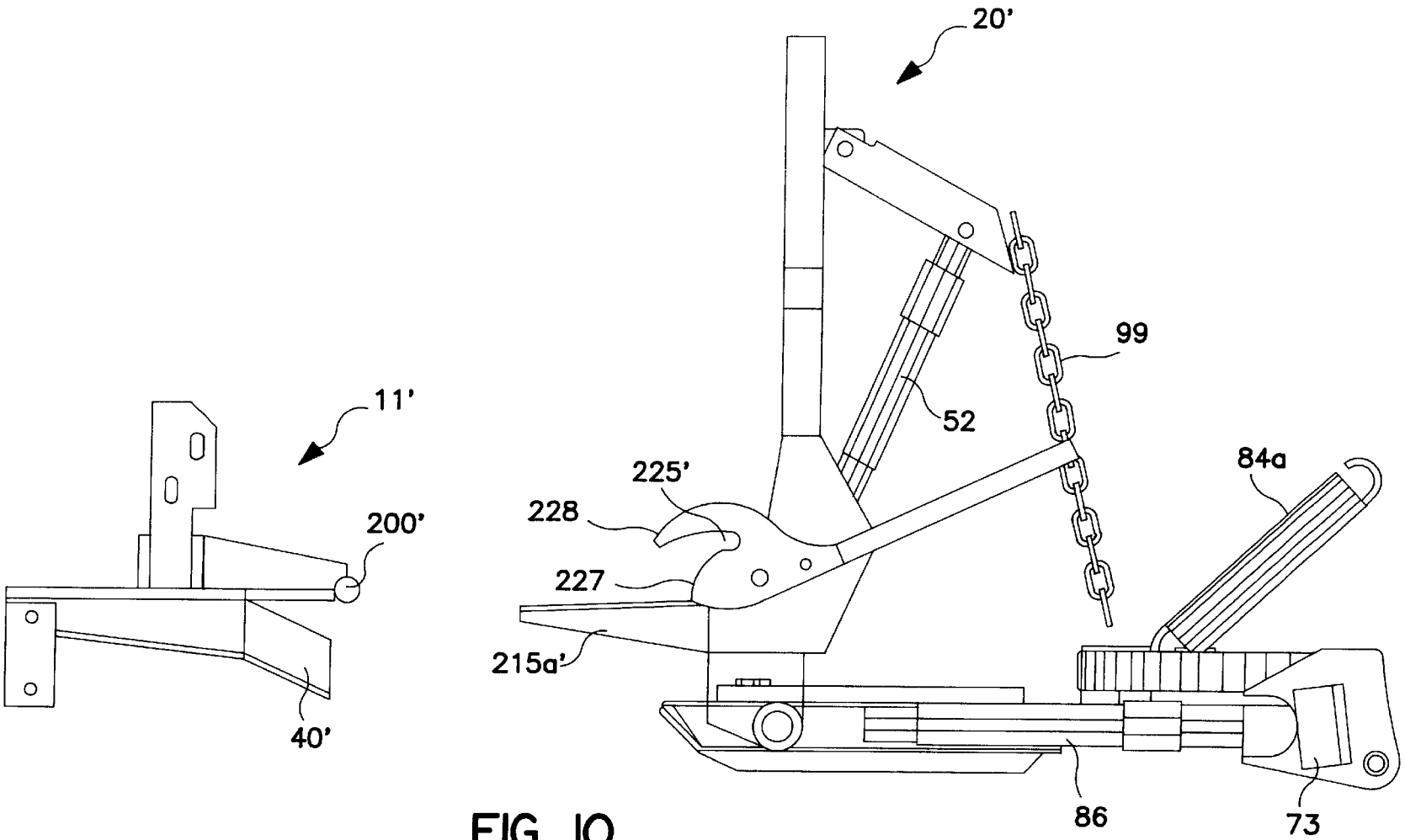
FIG. 10 is a side view of the snow blade mounting system in accordance with an alternative embodiment of the present invention.

An alternative embodiment of the male end 215 is shown in FIGS. 8–10. In this embodiment, the weight of the assembly is reduced by employing two spaced discontinuous male portions 215*a*' and 215*b*' tapering towards each other as shown. Each male portion 215*a*' and 215*b*' is configured to be received by corresponding spaced female guide members 40', 41' of the receiver plate 11', best seen in FIG. 9.

Pivotally coupled to each side gusset 54, 55 via pivot shaft 219 are respective latches 220. Preferably the latches 220 share a common pivot shaft, the pivot shaft extending from one latch to the other so that movement of the two latches is coordinated; actuation of one latch results in a corresponding movement of the other latch. In this way, the movement of the latches can be controlled by a single lever 221 coupled to one of the latches 220. Alternatively, separate pivot pins could be used for each latch 220, with each latch having separate means for actuation.

Figure 2:
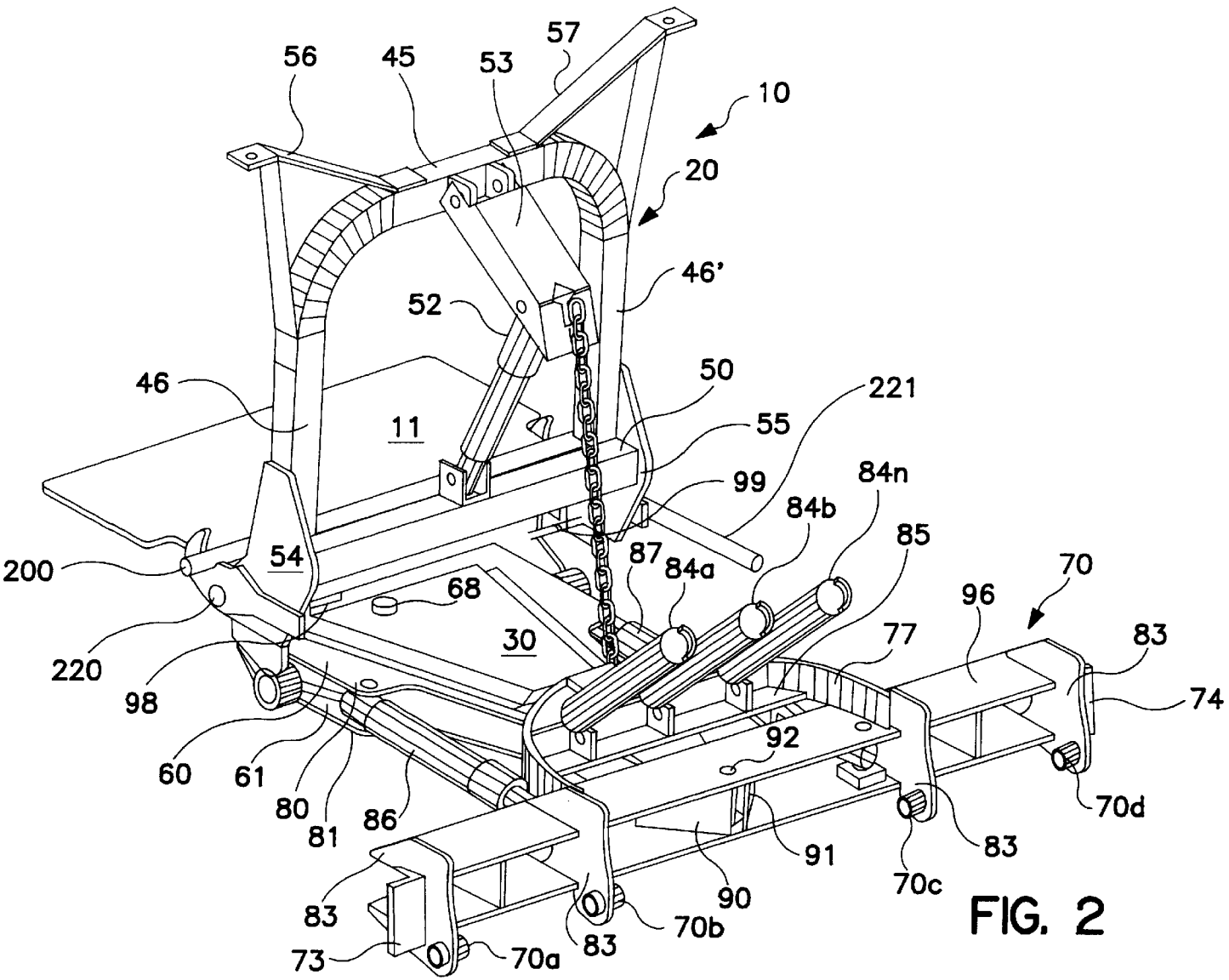
FIG. 2 is a perspective view of the snow blade assembly shown mounted in accordance with the present invention.
Figure 4:
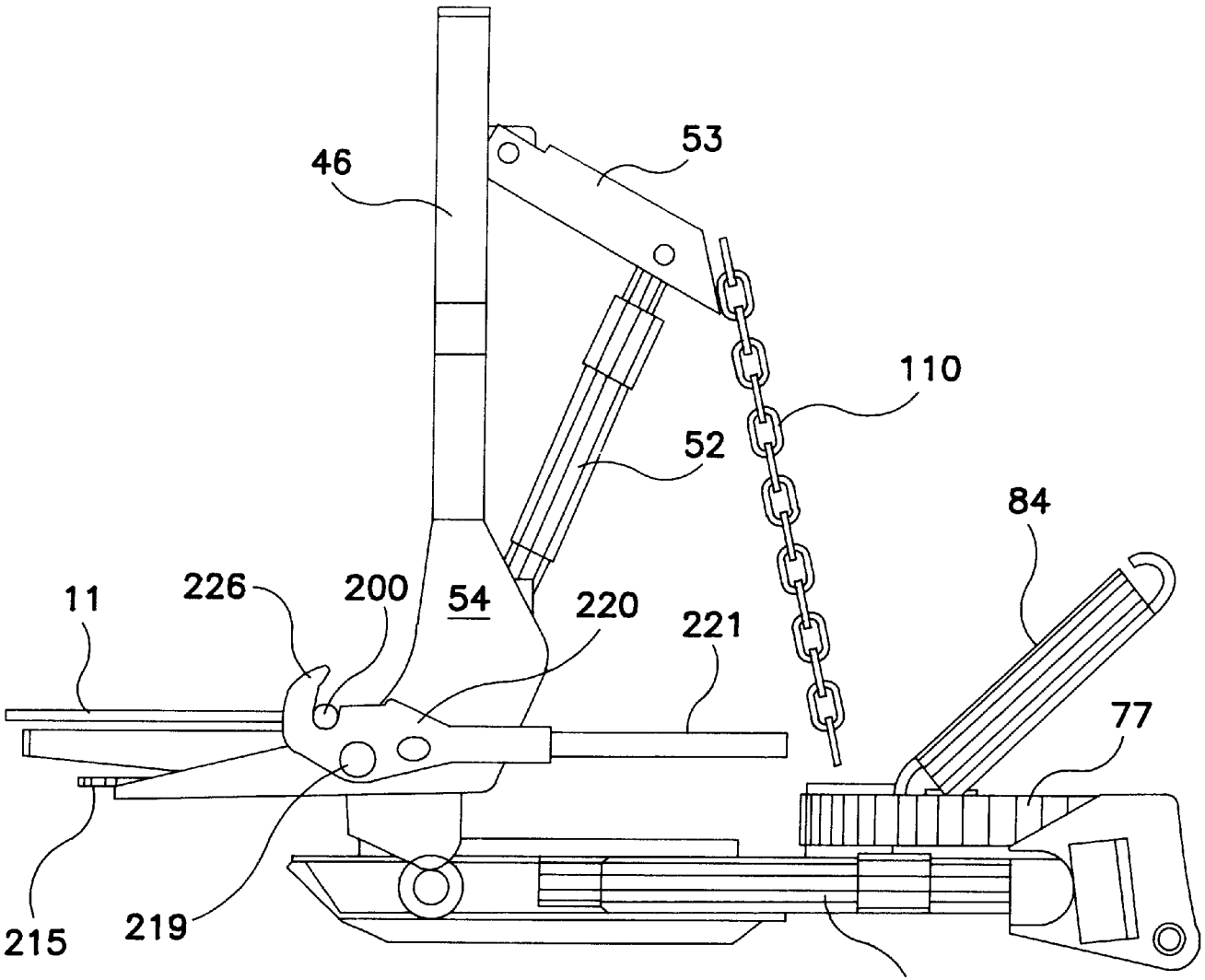
FIG. 4 is a side view of the snow blade assembly shown mounted in accordance with the present invention.
Figure 7A:
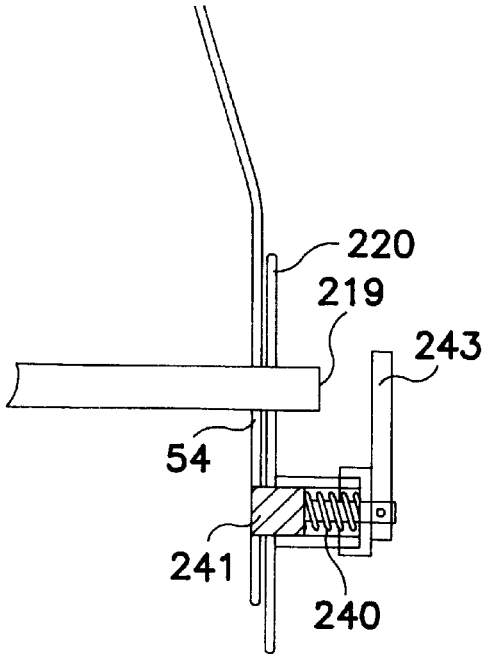
FIG. 7A is a cross-sectional view of the locking pin shown in the locked position in accordance with the present invention.
Figure 7B:
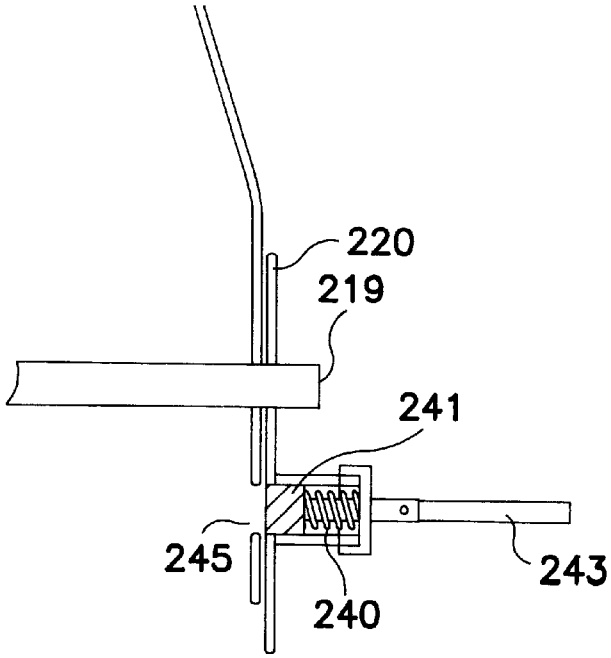
FIG. 7B is a cross-sectional view of the locking pin shown in the unlocked position in accordance with the present invention.

Each latch 200 has a hook shape including an arcuate recess 225 corresponding in angle to the circumference of the bar 200. The latch is thereby adapted to receive the bar 200 as shown in FIGS. 2 and 4. Preferably the tip 226 of the hook extends beyond the body of the latch as best seen in FIG. 3. This design facilitates the grasping and interlocking of bar 200 of receiver plate 11. A latch locking assembly means 230 is used to lock the apparatus in place. One suitable locking assembly, best seen in FIGS. 7A and 7B, includes a spring loaded pin assembly 230, with spring 240 biasing against pin 241. In the locked position of FIG. 7A, spring 240 forces pin 241 through an appropriately dimensioned aperture 245 (FIG. 7B) in side gusset 54, thereby fixing the latch 220 in place. Lever 243, shown in FIG. 7A in the locked (orthagonal) position, prevents pin 241 from retracting out of the aperture in the gusset 54. In the unlocked position of FIG. 7B, the pin is retracted from the aperture, allowing movement of the latch for engagement or disengagement of the hitch. Each latch 200 can have a safety lock, or preferably a single safety lock can be used, preferably in conjunction with the latch that is located on the same side of the apparatus as lever 221, for operator convenience.

Figure 6:
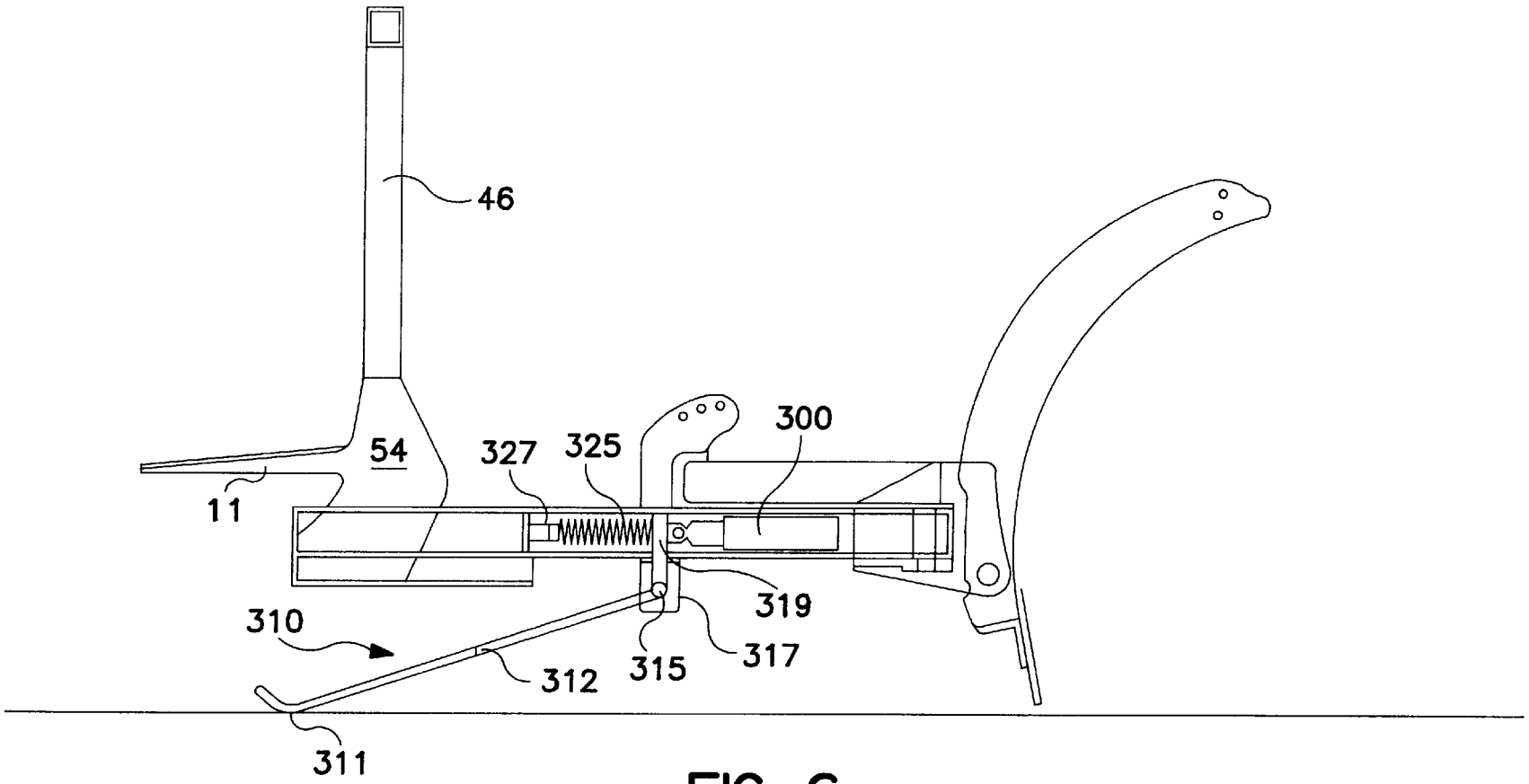
FIG. 6 is a cross-sectional view of the jack assembly in accordance with the present invention.

Turning now to FIG. 6, the jack assembly of the present invention is shown. The jack is preferably power operated such as by a hydraulic cylinder 300 positioned in the cavity of the A-frame as shown. The cylinder 300 is located in the body of the A-frame substantially between top and bottom surfaces 60, 61 in the actuator drive cavity, forward (away from the vehicle) of where the snow blade hydraulic assembly is located. Locating this jack drive means substantially within the body of the A-frame 30 lightens the lift frame 20 (where the pump was conventionally located) for easy removal. Instead, the dead weight of the jack drive means is advantageously added to the blade, assisting in creating a cleaner snowplow pass. Importantly, the jack drive means in this location in no way obstructs the radiator of the vehicle, thereby allowing proper air flow to cool the vehicle engine and help prevent overheating. In addition, the jack drive means is well sheltered, minimizing potential damage as the vehicle approaches the blade assembly for mounting. Preferably, the bulk of the jack drive means is located substantially in the horizontal plane of the A-frame defined by the top and bottom surfaces 60, 61. Jack foot 310, which preferably includes a curved skid shoe portion 311 and a relatively straight elongated portion 312 is coupled to tab 319, such as by welding, at about a 45° angle. This assembly is pivotally coupled to the A-frame assembly via pin 315 through opposite side gussets 317 (one shown) The jack shoe 311 is lowered by actuation of the hydraulic cylinder 300, which causes counter-clockwise rotational movement of the tab 319 about the axis of the pin 315. A return spring 325 biases against the cylinder 300 such that the jack 310 can be raised by retraction of the cylinder 300, this time by clockwise rotational movement of the tab 319 about the axis of the pin 315. An adjusting nut 327 is used to provide the proper tension on spring 325. By lowering the jack 310, the assembly can be raised to the appropriate height for engagement with the female receiving end of the hitch assembly mounted on the vehicle. This design allows for raising or lowering of the jack to virtually any extent within its raised (i.e., stowed in a position substantially parallel to the A-frame) and lowered (i.e., as shown in FIG. 6) range, in contrast to the prior art which allowed for only incremental lowering or raising (such as in half inch or one inch increments). This greatly facilitates the mounting operation, especially where the height of the lift assembly has changed, such as due to snow accumulation on the ground. Preferably the hydraulic controls are placed in an accessible location, such as the front of the vehicle grill, so that the operator can operate the jack while visually inspecting the height of the lift assembly and align it appropriately with the vehicle. Preferably the hydraulic controls include a flow divider which routes the hydraulic fluid to either the actuator drive or to the jack drive, as needed.

In a preferred embodiment, the jack activation switch includes two built-in safety features. When the jack is to be used, it is controlled by a switch on the A-frame (or the vehicle grill). However, the switch will not activate the jack unless the in-cab controls are locked in the float (i.e., lower) position, as only in this position is power supplied to the jack switch. As a result, it is not possible to operate the jack while the snow plow is in the raised position, as this could be potentially hazardous to the user. In addition, once the plow is locked securely on the vehicle, if the jack is not retracted, there is a wired-in safety to ensure that the jack arm is retracted prior to activating the plow blade. Specifically, the in-cab plow blade lift control is wired to the jack retract circuit. As a result, if the jack is not retracted, when the operator used the in-cab lift function, the jack will automatically retract, making it impossible to operate the snow plow blade with the jack in the extended position.

In operation, the vehicle is positioned close to the hitch assembly, and the jack mechanism is operated so that the lift assembly is raised or lowered depending upon the height of the receiver plate 11. Once the proper height is achieved (as determined by visual inspection), the vehicle is driven towards the male end 215 of the hitch assembly so that it is received under the receiver plate 11. At this point the latches 220 are in the unlocked position shown in FIG. 1, configured to grasp and engage the bar 200. Once the bar 200 is positioned in the recesses 225 of the latches 220, the lever 221 is used to draw the latches 220 around the bar 200 and interlock the same, as shown in FIG. 2. The lift assembly is now locked to the vehicle chassis. The jack is then lifted back substantially parallel with the A-frame where it is stowed during use of the plow. To disengage the lift assembly from the chassis, the jack is lowered to the ground to support the assembly, and the lever 221 is placed in the up position, which pushes the latch away from the bar 200, disengaging the same and actually pushing the receiver plate 11 away from the lift assembly.

Turning now to FIGS. 8–11, an alternative embodiment of the present invention is illustrated. In this embodiment, the lift frame 20' is similar to the lift frame of the previous embodiment, except for the positioning of the latches 220'. Specifically, the latches 220' are positioned such that the arcuate recess 225' is open to (i.e., faces) the bar 200' of receiver plate 11' when in the unattached position. Each latch 220' includes a lower sloped portion 227 that serves to guide bar 200' into the arcuate recess 225', and an opposite hook 228 that helps engage the bar 200' once guided into arcuate recess 225'.

Figure 11:
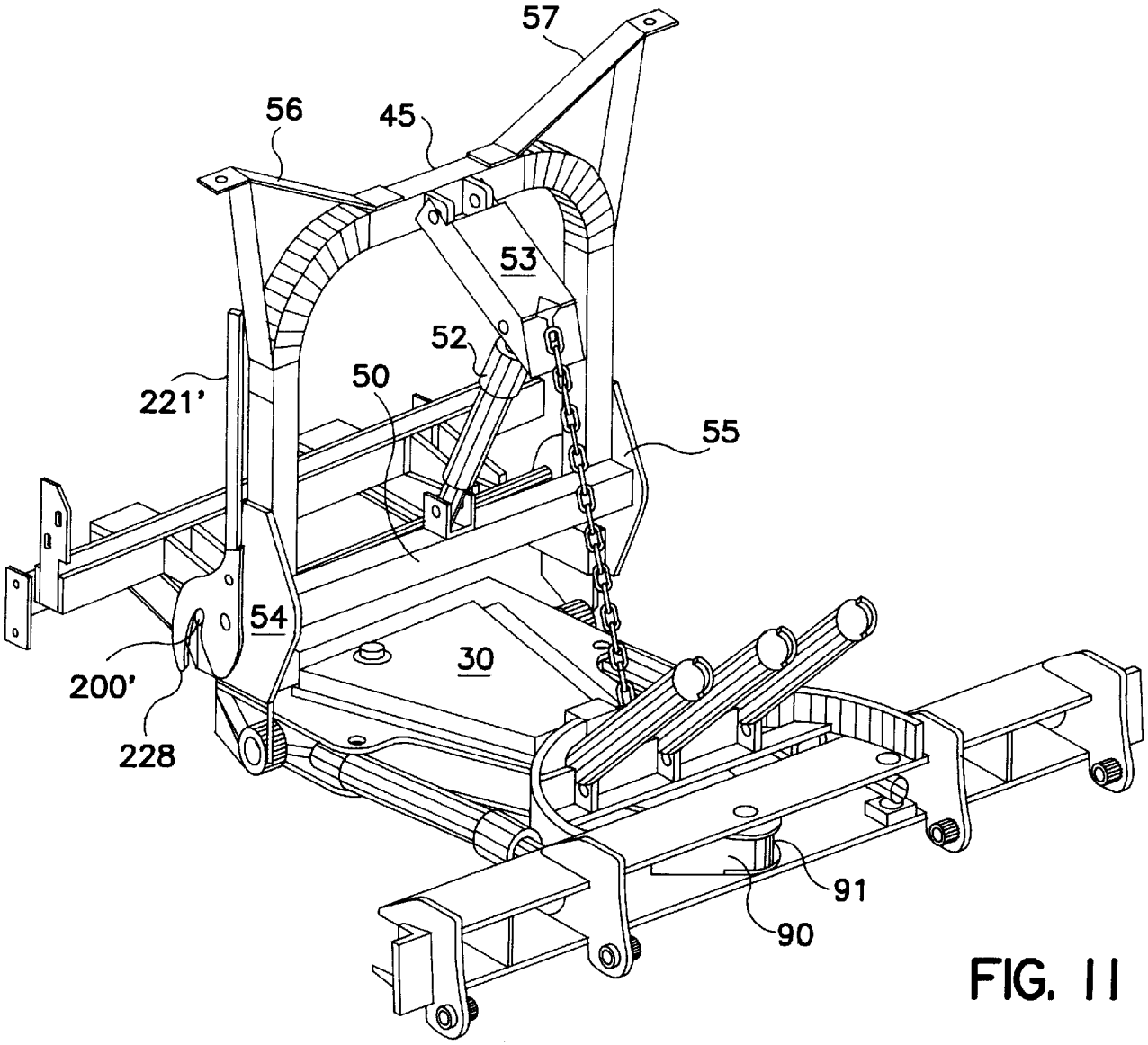
FIG. 11 is a perspective view of the snow blade mounting system in the locked position in accordance with an alternative embodiment of the present invention.

This positioning of latches 220' relative to bar 200' allows for the automatic or semi-automatic mounting of the lift frame 20' to the vehicle. Once the height of the lift frame 20' relative to the bar 200' is appropriately positioned (which is preferably accomplished by proper movement of the jack as discussed above), the vehicle to which the receiver plate 11' is attached is simply driven towards the lift frame 20' until the latches 220' engage the bar 200'. Due to the configuration of the slope portion 227, hook portion 228 and arcuate recess 225', the force of the bar 200' engaging the latches 220' cause the latches 220' to rotate counter-clockwise and lock the bar 200' in place (FIG. 11). Suitable locking pins (not shown) or other safety locking mechanism can be used to ensure that the lift frame 20' does not prematurely disengage from the vehicle.

This configuration greatly facilitates the mounting procedure and reduces the risk of injury, as the operator is inside the vehicle during the mounting process. In the event the lift frame 20' was not properly aligned with the receiver plate 11' during the procedure and the latches 220' do not completely lock automatically, the operator can complete the locking process by proper manual counter-clockwise rotation of the handle 221' of the latch.

Those skilled in the art will appreciate that although the lift frame of the alternative embodiment can be automatically mounted to the vehicle as detailed above, the present invention also includes within its scope the case where the lift frame of the alternative embodiment is manually mounted by proper manual actuation of the latch handle 221'.

What is claimed is:

1. A mounting hitch assembly for a vehicle having a chassis, comprising:

a hitch receiver fixed to said vehicle chassis and adapted to detachably receive a lift assembly, said hitch receiver comprising a first guide, a second guide spaced from said first guide, and at least one bar, said first and second guides defining therebetween a cavity and being positioned beneath said at least one bar;

a first male extension extending from said lift assembly and being adapted to be received by said first guide in said cavity;

a second male extension extending from said lift assembly, said second male extension being spaced from said first male extension and being adapted to be received by said second guide in said cavity;

a first latch on said lift assembly movable with respect to said lift assembly;

a second latch on said lift assembly spaced from said first latch and movable with respect to said lift assembly;

said first and second latches each having a recess for receiving at least one said bar such that when said lift assembly is mounted to said hitch receiver, said recess faces away from said chassis.

2. The mounting hitch assembly of claim 1, wherein said recesses are arcuate for receiving at least one said bar.

3. The mounting hitch of claim 1, wherein said lift assembly comprises an A-frame having a first end and a second end spaced from said first end, and wherein said A-frame second end comprises pivot means, and further comprising snow blade mounting means comprising a trip frame pivotally mounted to said second end pivot means for mounting a snow blade.

4. The mounting hitch of claim 3, wherein between said first end and said second end of said A-frame is a cavity, said hitch further comprising actuator drive means mounted in said cavity for lifting said snow blade.

5. The mounting hitch of claim 4, wherein said lift assembly comprises at least one actuator driven by said actuator drive means for lifting said snow blade.

6. The mounting hitch of claim 4, further comprising a power operated jack pivotally coupled to said lift assembly, and power means to operate said jack assembly housed in said cavity.

7. The mounting hitch of claim 1, further comprising a power operated jack pivotally coupled to said lift assembly for raising or lowering said lift assembly relative to said vehicle chassis.

8. The mounting hitch of claim 7, wherein said jack comprises a shoe, an elongated portion and a tab attached to said elongated portion, whereby rotational movement of said tab causes raising or lowering of said shoe with respect to said chassis. said first and second latches each having a recess for receiving said bar such that when said lift assembly is mounted to said hitch receiver, said recess faces away from said chassis.

9. The mounting hitch assembly of claim 1, wherein said first male extension has a first free end, said second male extension has a second free end, and wherein said first and second free ends taper towards each other.

10. A method of raising a lift assembly relative to a substrate on which said lift assembly is supported for positioning said lift assembly for mounting to a vehicle chassis, comprising:

providing a utilitarian accessory coupled to said lift assembly;

causing said utilitarian accessory to contact said substrate;

providing a jack pivotally coupled to said lift assembly, said jack having a free end, said jack being pivotable with respect to said lift assembly only when said utilitarian accessory is contact with said substrate, said jack being so pivotable between a retracted position in which said free end is not in contact with said substrate and a lowered position in which said free end is in contact with said substrate;

pivoting said jack to cause said jack free end to move from said first position towards said substrate;

ceasing said pivoting when said free end is in contact with said substrate and raises said lift assembly to a desired height above said substrate.

11. The method of claim 10, wherein said utilitarian accessory is a snow plow blade.

12. A method of mounting to a vehicle chassis a lift assembly having a utilitarian accessory attached thereto, comprising:

providing a hitch receiver fixed to said vehicle chassis, said hitch receiver having at least one bar adapted to be detachably received by said lift assembly;

providing latch means for engaging said at least one bar of said hitch receiver and attaching said lift assembly thereto, said latch means comprising a pair of spaced hooks pivotally coupled to said lift assembly;

providing a jack pivotally coupled to said lift assembly, said jack having a free end that is not in contact with said substrate when said jack is in a retracted position;

actuating said jack to cause said jack free end to pivot towards said substrate only when said utilitarian accessory is in contact with said substrate;

aligning said lift assembly with said chassis by ceasing said actuation when said free end is in contact with said substrate and raises said lift assembly to a desired height above said substrate;

driving said vehicle chassis towards said lift assembly, causing said latch means to engage said at least one bar and attach said lift assembly to said hitch receiver.

13. The method of claim 12, wherein said jack comprises a shoe, an elongated portion attached to said shoe, and a tab attached to said elongated portion, said jack being pivotally coupled to said lift assembly between said elongated portion and said tab via a pivot axis; and said method further comprising causing said tab to move rotationally about said pivot axis, said rotational movement of said tab causing a corresponding lowering of said shoe with respect to said vehicle chassis.

* * * * *